US007743684B2

(12) United States Patent
Guile et al.

(10) Patent No.: US 7,743,684 B2
(45) Date of Patent: Jun. 29, 2010

(54) TOOL FOR REMOVING AND APPLYING A FASTENING DEVICE

(76) Inventors: Dennis Guile, 5801 Hickory Meadows Dr., White Lake, MI (US) 48383; Louis P. Knapp, 48052 Meadow La., Chesterfield, MI (US) 48051

( * ) Notice: Subject to any disclaimer, the term of this patent is extended or adjusted under 35 U.S.C. 154(b) by 0 days.

(21) Appl. No.: 12/390,655

(22) Filed: Feb. 23, 2009

(65) Prior Publication Data

US 2009/0211411 A1 Aug. 27, 2009

Related U.S. Application Data

(60) Provisional application No. 61/031,892, filed on Feb. 27, 2008.

(51) Int. Cl.
*B25B 13/06* (2006.01)

(52) U.S. Cl. ..... 81/125

(58) Field of Classification Search ..... 81/125, 81/124.1, 13, 435
See application file for complete search history.

(56) References Cited

U.S. PATENT DOCUMENTS

| | | | | | |
|---|---|---|---|---|---|
| 848,194 | A | * | 3/1907 | McMurtry | 81/124.1 |
| 851,181 | A | * | 4/1907 | McMurtry | 81/124.1 |
| 1,537,929 | A | * | 5/1925 | Lee | 81/125 |
| 1,543,175 | A | * | 6/1925 | Mccarthy | 81/125 |
| 1,585,338 | A | * | 5/1926 | Fisher et al. | 81/125 |
| 1,607,421 | A | * | 11/1926 | Work | 81/125 |
| 2,412,275 | A | * | 12/1946 | Klopovic | 81/125 |
| 2,611,289 | A | * | 9/1952 | Frank | 81/125 |
| 2,632,351 | A | * | 3/1953 | Hannah | 81/125 |
| 2,770,157 | A | * | 11/1956 | Moreo | 81/125 |
| 2,930,267 | A | * | 3/1960 | Apicelli | 81/475 |
| 2,993,397 | A | * | 7/1961 | Albertson et al. | 81/125 |
| 3,005,367 | A | * | 10/1961 | Vose | 81/125 |
| 3,114,278 | A | * | 12/1963 | Thomas | 81/124.1 |
| 3,416,395 | A | * | 12/1968 | Hanson | 81/125 |
| 4,244,246 | A | * | 1/1981 | Gillett | 81/125 |
| 4,553,454 | A | * | 11/1985 | Laskey | 81/125 |
| 5,437,211 | A | * | 8/1995 | Wolfe | 76/114 |
| 5,551,321 | A | * | 9/1996 | Bottiglieri | 81/125 |
| 5,590,574 | A | * | 1/1997 | Lide | 81/124.1 |
| 5,640,889 | A | * | 6/1997 | Anderson | 81/125 |
| D411,723 | S | * | 6/1999 | Lamerrill | D8/29 |
| 6,557,727 | B1 | * | 5/2003 | Robertson | 221/278 |
| 6,634,261 | B1 | * | 10/2003 | Griffin | 81/124.1 |

* cited by examiner

*Primary Examiner*—David B Thomas
(74) *Attorney, Agent, or Firm*—Gifford, Krass, Sprinkle, Anderson & Citkowski, P.C.

(57) ABSTRACT

A tool for removing and applying a fastening device from and to a threaded stud is provided. The tool includes an elongated chamber and a retainer having a pair of spaced apart portions configured to hold fastening devices within the chamber. The tool further includes a positioning mechanism for positioning stored fastening devices for later installation onto the stud. In one embodiment, the retainer includes a worm gear. Opposing portions of the catch of the worm gear hold the fastening device. The positioning mechanism includes a cam assembly configured to rotate the shaft wherein the rotary movement of the shaft is translated into an axial movement of the fastening device within the chamber. In a second preferred embodiment, the retainer includes a pair of keepers configured to hold a fastening device. The positioning mechanism is operable to feed a fastening device into the keeper.

14 Claims, 8 Drawing Sheets

TOOL FOR REMOVING AND APPLYING A FASTENING DEVICE

CROSS-REFERENCE TO RELATED APPLICATIONS

This application claims priority of U.S. Provisional Patent Application Ser. No. 61/031,892 filed Feb. 27, 2008, which is incorporated herein by reference.

FIELD OF THE INVENTION

The present invention is related to a tool for removing and applying a fastening device from and to a threaded stud. In particular the present invention is related to a tool having an elongated chamber for storing fastening devices as they are being removed from the threaded stud. The tool is also configured to apply the stored studs onto a threaded stud.

BACKGROUND OF THE INVENTION

Fastening devices such as bolts and lug nuts are used universally to fasten and secure parts together. For instance, a bolt or lug nut may be used to secure a wheel onto the hub of a vehicle. In order to remove the wheel from the vehicle each individual lug nut must be released from the threaded stud so as to free the wheel from the vehicle. These lug nuts are small and may be easily misplaced. Accordingly it is desirable to have a tool which is configured to not only remove lug nuts but also to store the lug nuts for later application onto a threaded stud.

SUMMARY OF THE INVENTION

A tool for removing and applying a fastening device from and to a threaded stud is provided. The tool includes an elongated chamber and a retainer having a pair of spaced apart portions configured to hold fastening devices in a predetermined position within the chamber. The fastening device is held between the opposite portions. The tool further includes a positioning mechanism for positioning the stored fastening devices for later installation onto the stud.

In the first preferred embodiment, the retainer includes a worm gear housed in a worm gear chamber. The worm gear has a shaft and a catch spiraling around the shaft. The axial distance between opposite portions of a complete revolution of the catch is configured to hold a fastening device. The positioning mechanism includes a cam assembly configured to rotate the shaft to a neutral position wherein the rotary movement of the shaft is translated into an axial movement of the fastening device within the elongated chamber.

In a second preferred embodiment, the retainer includes a pair of keepers spaced apart from each other, and the positioning mechanism includes a chamber spring operable to urge the fastening devices into the pair of keepers. The keepers are disposed adjacent the mouth of the chamber opening. The keepers are pivotably mounted within the chamber and pivot between a first position and a second position. In the first position, the ends of the keeper nearest the chamber opening are pivoted away from each other. In the second position, the ends of the keeper furthest from the chamber opening are pivoted away from each other.

The positioning mechanism of the second preferred embodiment is operable to feed a fastening device into the keeper, and the keepers are pivoted so as to accept a fastening device from the stud and to prevent lug nuts upstream the keeper from acting on a fastening device held within the keeper.

DETAILED DESCRIPTION OF THE INVENTION

Figure 1:
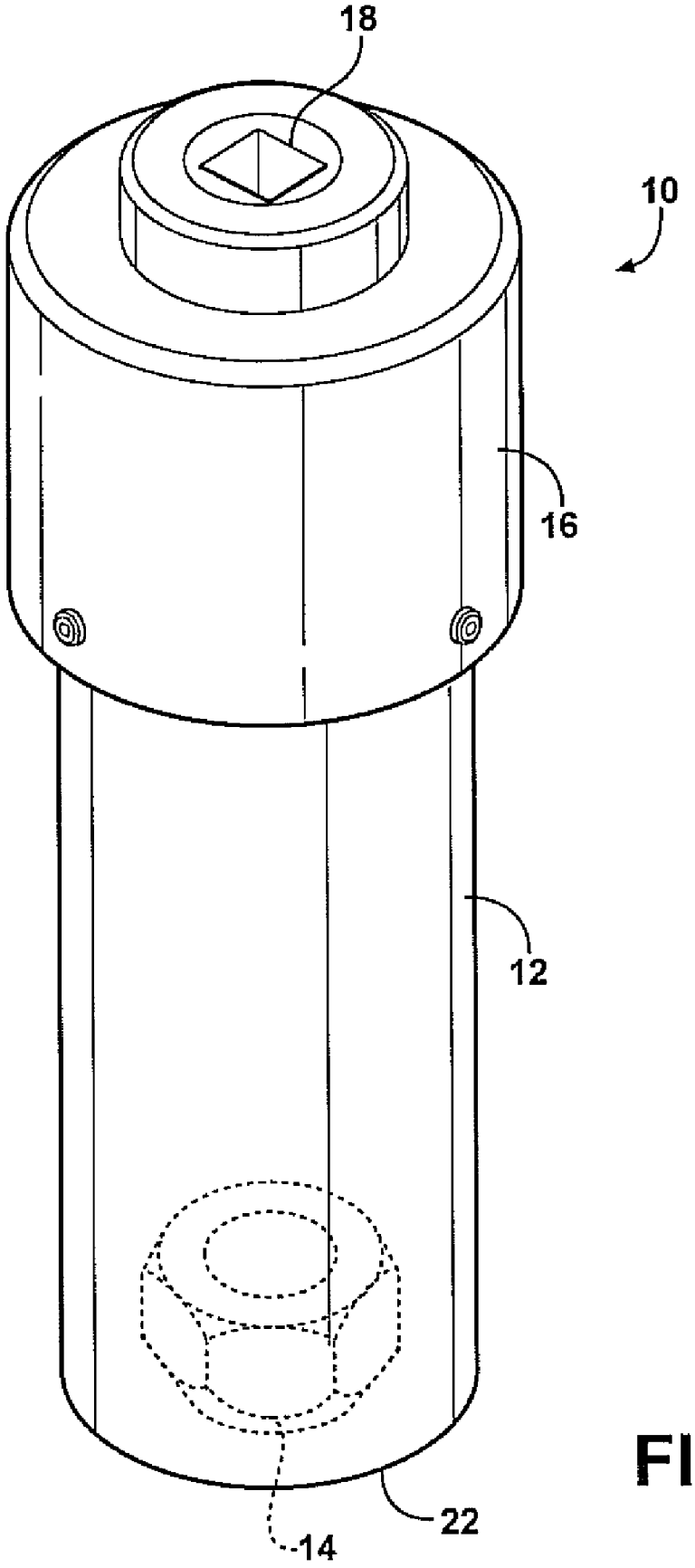
FIG. 1 is an illustration of a lug nut removal tool.

Referring to the figures wherein like numerals indicate corresponding parts throughout the several views, a tool 10 having an elongated chamber 12 configured to fittingly engage a predetermined fastening device 14 is provided. The tool 10 includes a housing 16 and a socket 18 mounted onto the housing 16. The socket 18 is configured to receive the head of a driver operable to turn die tool 10 so as to release or apply a fastening device 14 from a threaded stud 20.

The elongated chamber 12 is spaced apart and opposite the socket 18 and extends from the housing 16 away from the socket 18. The elongated chamber 12 has a predetermined length configured to hold a predetermined number of fastening devices 14. For illustrative purposes only the opening 22 of the elongated chamber 12 is configured to fittingly engage and hold five lug nuts 14.

Preferably the tool 10 is made of a strong and resilient material that will enable the tool 10 to withstand pressure from a pneumatic driver and torque associated with the removal of fastening devices 14 such as a lug nut 14. An example of such a material is steel, titanium, or the like.

In operation, a driver such as a ratchet or an impact gun is mounted onto the socket 18. For illustrative purposes, the tool 10 is operable to remove and install a lug nut. The opening 22 of the elongated chamber 12 is simply placed onto a lug nut 14. The driver may then be actuated so as to turn the housing 16 thereby turning the lug nut 14 with respect to the stud. The driver is actuated until the lug nut 14 is free of the threaded stud 20, and stored within the elongated chamber 12 for later installation. However, as the lug nut 14 is free of the stud, the lug nut 14 is not in a position to engage the stud. Accordingly, the tool 10 includes a retainer 24 for holding the lug nuts 14 in a predetermined position within the chamber 12, and a positioning mechanism 26 operable to position the lug nuts 14 within the chamber 12 so as to enable the lug nut 14 to be later driven onto another like stud.

With reference to FIG. 1 a first preferred embodiment of the tool 10 is provided. In the first preferred embodiment, the retainer 24 includes a worm gear 28 rotatably mounted within a worm gear chamber 30 located within the elongated chamber 12. The worm gear 28 has a shaft 32 including a head and a catch 34 spiraling along the shaft 32 so as to form a screw. Portions of the catch 34 extend into the elongated chamber 12. The spiraling catch 34 is configured to fit a lug nut 14 between a complete revolution around the shaft 32. Specifically, the catch 34 is configured to retain a lug nut 14 between opposite portions 36 of the catch 34. The distance between opposite portions 36 of the catch 34 may be varied so as to hold different sized lug nuts 14 by adjusting the pitch of the catch 34 around shaft 32.

The retainer 24 may further include a bearing assembly 38 to facilitate the rotary movement of the worm gear 28. The bearing assembly 38 includes a plurality of bearings 40 and washers 42. The bearing assembly 38 is mounted onto the shaft 32 of the worm gear 28. Bearing assemblies are currently known and used illustratively including a washer 42 having bearings rotatably mounted therein.

The axial movement of the lug nut 14 along the stud causes the worm gear 28 to rotate and hold the lug nut 14 in a predetermined position along the elongated chamber 12. As the lug nut 14 moves axially along the stud and away from the base of the stud, the forward edge of the lug nut 14 abuts against an exposed portion of the catch 34 causing the worm gear 28 to rotate until the lug nut 14 is free of the stud. The lug nut 14 is held between the pair of spaced apart portions 36 of the catch 34 and will not be able to engage a like stud as the lug nut 14 is too far down into the chamber 12. However, once the tool 10 is free of the exposed stud, the positioning mechanism 26 is operable to rotate the worm gear 28 so as to position the stud closer to the chamber 12 opening 22 where the lug nut 14 may engage a like stud.

The positioning mechanism 26 includes a cam assembly 44. The cam assembly 44 is operable to rotate the worm gear 28 so as to return the worm gear 28 to a neutral position 46. The rotation of the worm gear 28 to the neutral position 46 displaces the lug nut 14 or lug nuts 14 within the chamber 12 axially along the chamber 12 to an engaged position. Specifically, the lug nut 14 closest to the opening 22 of the chamber 12 is moved towards the opening 22 so as to be able to engage a like stud.

Figure 2:
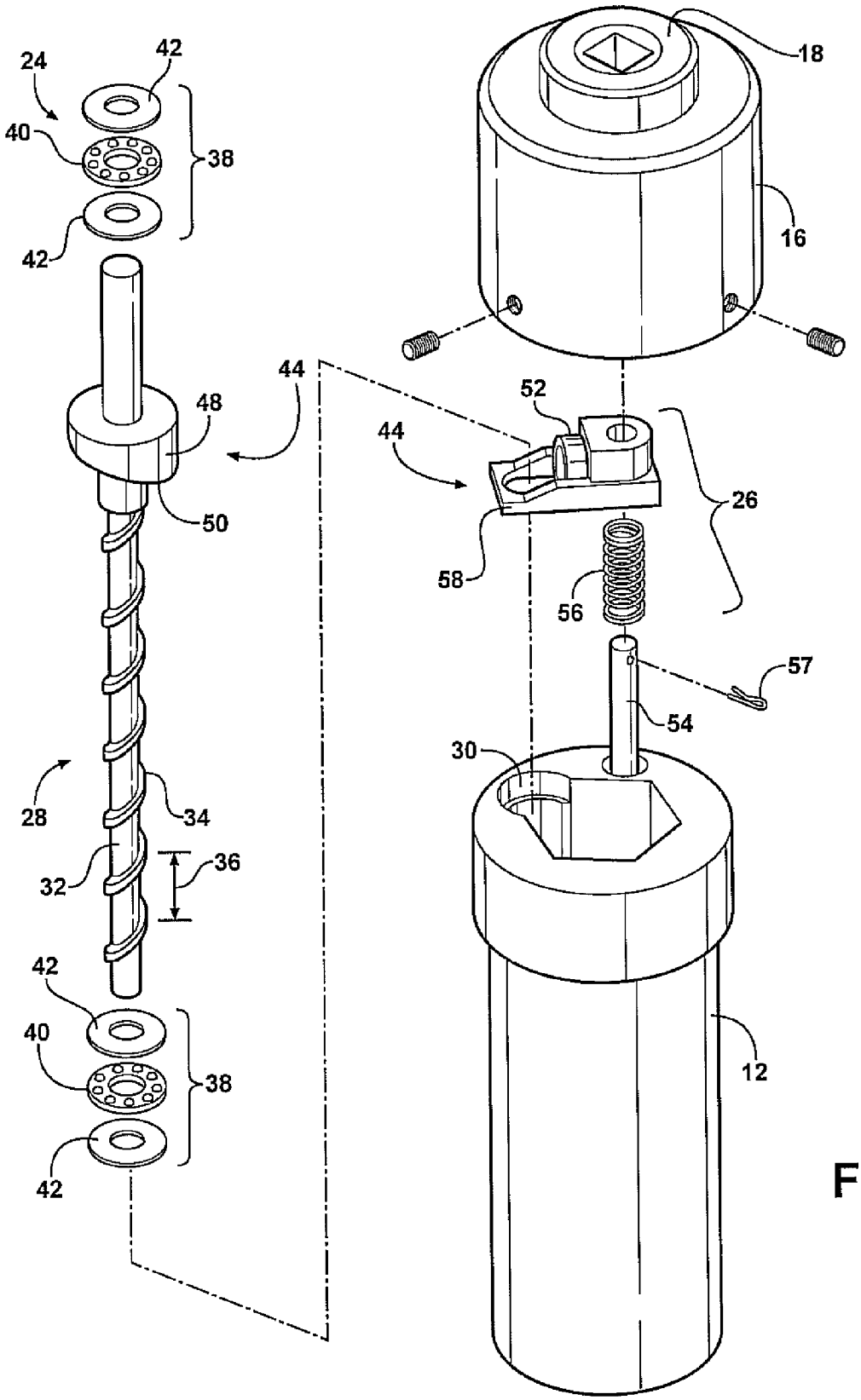
FIG. 2 is an exploded view of an embodiment of the first preferred embodiment of the tool showing the various parts.
Figure 3:
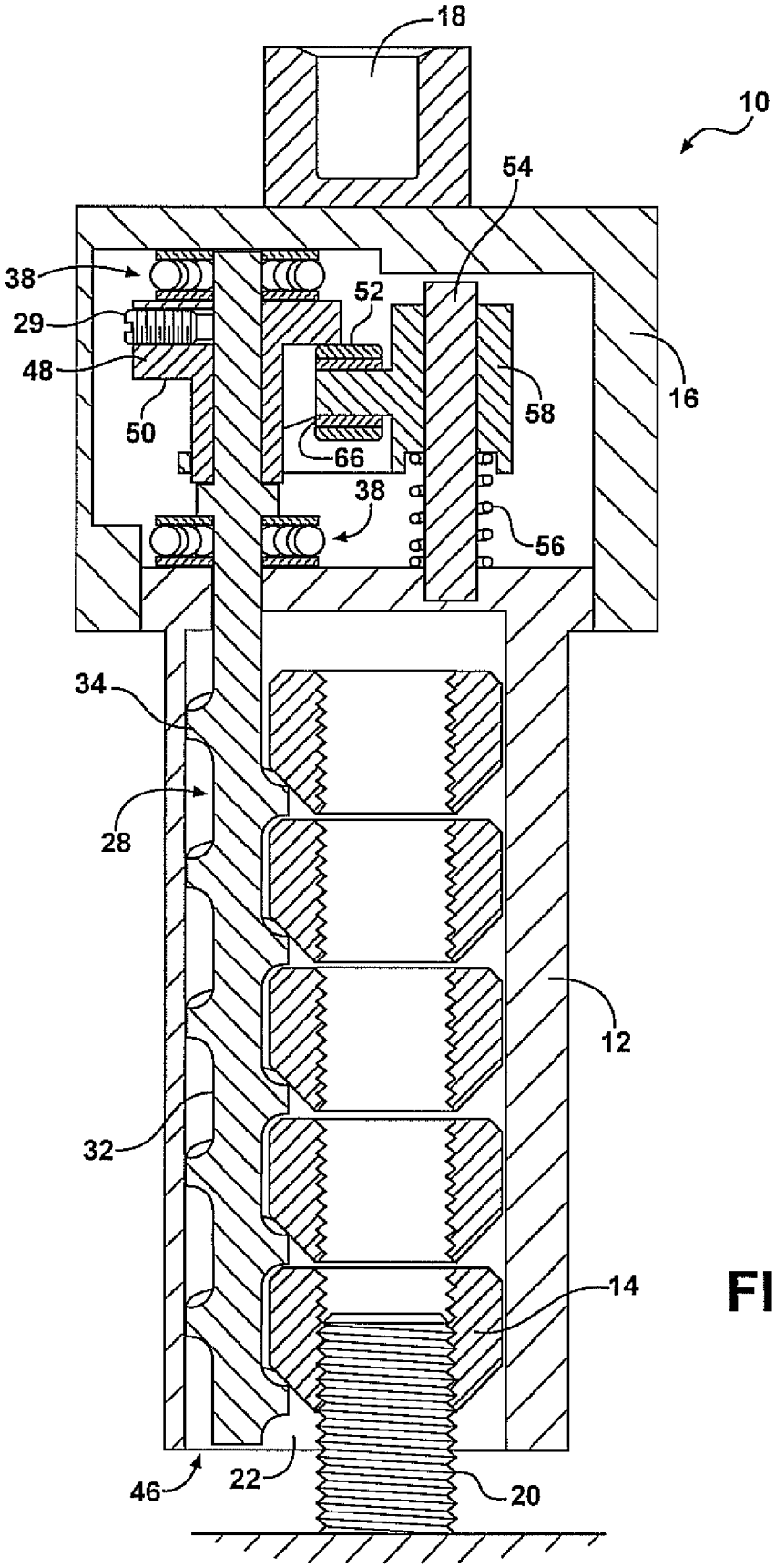
FIG. 3 is across-sectional view taken along the length of the assembled tool of FIG. 2.

Cam assemblies 44 are known and are suitable for use herein, illustratively including the cam assembly 44 shown in FIGS. 2-5. With reference now to FIGS. 2 and 3 an embodiment of a cam assembly 44 is provided. The cam assembly 44 includes a first cam 48 fixedly mounted to the shaft 32 of the worm gear 28. The first cam 48 may be integrally formed with the worm gear 32, or may be fixed to the worm gear 28 by a set screw 29. The first cam 48 has a cam surface 50. A portion of the cam surface 50 is displaced relative to the remaining cam surface 50 so as to give the cam surface 50 a sloped shape. A set of washers 42 and bearings 40 may also be mounted onto the shaft 32 of the worm gear 28 so as to facilitate the rotary movement of the worm gear 28.

The cam assembly 44 further includes a cam follower 52, a guide pin 54 and a spring 56 housed within the housing 16. The cam follower 52 also includes a cam follower base 58, having an aperture configured to slidingly engage the guide pin 54 so as to keep the cam surface 50 in contact with the cam follower 52. The guide pin 54 is fixed within the housing 16, and a spring 56 is mounted over the guide pin 54 and is disposed between the chamber 12 and the cam follower base 58. A stop 57, such as a clip, may be mounted onto the guide pin to retain the cam follower base 58 onto the guide pin 54. The spring 56 is operable to urge the cam follower base 58 towards the socket 18. The cam follower 52 is mounted within the housing 16 such that the cam follower base 58 cannot rotate.

In another embodiment, the tool 10 may further include a retaining arm 60 (not shown) fixedly mounted within the housing 16. The retaining arm 60 includes an arm 62 and a retaining body 64. The retaining body 64 is in contact with the cam follower base 58 and prevents the cam follower base 58 from pivoting within the housing 16. The arm 62 is engaged with a portion of the worm gear 28 shaft 32 so as to keep the first cam 48 in contact with the cam follower 52.

The cam assembly 44 works in concert with the first cam 50 so as to rotate the worm gear 28 and urge the worm gear 28 to return to the neutral position 46. Specifically, the spring 56 urges the cam follower 52 against the cam surface 50 of the first cam 48 causing the first cam 48 to rotate until the cam follower 52 can rest against the first cam 48 surface. With reference to FIG. 3, the first cam 48 surface is generally sloped so the cam follower 52 will rest against the upper most portion of the first cam 48.

Thus, as the tool 10 unscrews a lug nut 14 from a stud, the lug nut 14 moves axially along the stud away from the base of the stud. The worm gear 28 is not free to rotate when the lug nut 14 is engaged with the stud. Thus, spring 56 is prevented from rotating the cam follower 52. However, when the lug nut 14 is free of the stud the worm gear 28 is free to rotate, and the spring 56 is free to compress the cam follower 52 against the cam surface 50 of the first cam 48. The first cam 48 rotates until the cam follower 52 may rest against the first cam 48 surface, thereby rotating the worm gear 28 to the neutral position 46 and positioning the lug nut 14 in the engaged position.

With reference again to FIG. 3, the first cam 48 and the cam follower 52 remain in contact with each other. The spring 56 is continuously urging the cam follower 52 towards the socket 18. Thus at any given time, the cam follower 52 is always urging the cam to rotate the worm gear 28 such that the cam follower 52 comes to rest against the narrow portion of sloped cam surface 50 of the first cam 48. Thus, when a lug nut 14 is mounted to the stud, or in contact with the stud, the spring 56 is prevented from acting freely. However, when the lug nut 14 is free of the stud, the spring 56 is operable to urge the cam follower 52 to rotate the first cam 48 such that the narrow portion of the sloped cam surface 50 is in contact with the cam follower 52 which in turn rotates the worm gear 28 so as to position the lug nut 14 in an engaged position.

The cam follower 52 may include a plurality of rollers 66. Each of the plurality of rollers 66 extends transversely across an inner surface of the cam follower 52 so as to facilitate the rotary movement of the first cam 48 against the outer contact surface of the cam follower 52.

In operation a device such as a ratchet or an impact gun may be used to operate the tool 10. The ratchet head is seated within the socket 18 and the ratchet is used to rotate the tool 10 so as to disengage a lug nut 14. It is inherent that the tool 10 may be rotated oppositely to fasten a lug nut 14 onto the stud.

To remove the lug nut 14 from the stud, the tool 10 opening 22 is mounted onto the nut and the tool 10 is rotated by applying a force onto the ratchet handle. As the tool 10 engages and rotates the lug nut 14, the lug nut 14 begins to move axially along the threaded stud 20 away from the base of the stud. The axial movement of the lug nut 14 causes the worm gear 28 to rotate. Specifically the forward end of the lug nut 14 abuts against catch 34 of the worm gear 28. As the lug nut 14 continues to move axially along the stud, the worm gear 28 continues to rotate. Upon a complete revolution, the lug nut 14 is disposed between opposite portions 36 of the catch 34 as shown in FIG. 3. The tool 10 may be used to remove and store other like lug nuts 14.

As described above, once the lug nut 14 is free of the stud, the worm gear 28 is free to rotate. Thus, the spring 56 is operable to urge the cam follower base 58 away from the opening 22 of the elongated shaft 32. This causes the cam follower 52 to ride along the first cam 48 surface, rotating the first cam 48 until the cam follower 52 comes to rest and the worm gear 28 returns to the neutral position 46. The rotation of the worm gear 28 to the neutral position 46 displaces the lug nuts 14 closer to the engaged position where the lug nut 14 nearest the opening 22 is able to engage a like threaded stud 20 having a predetermined exposed length.

Figure 4:
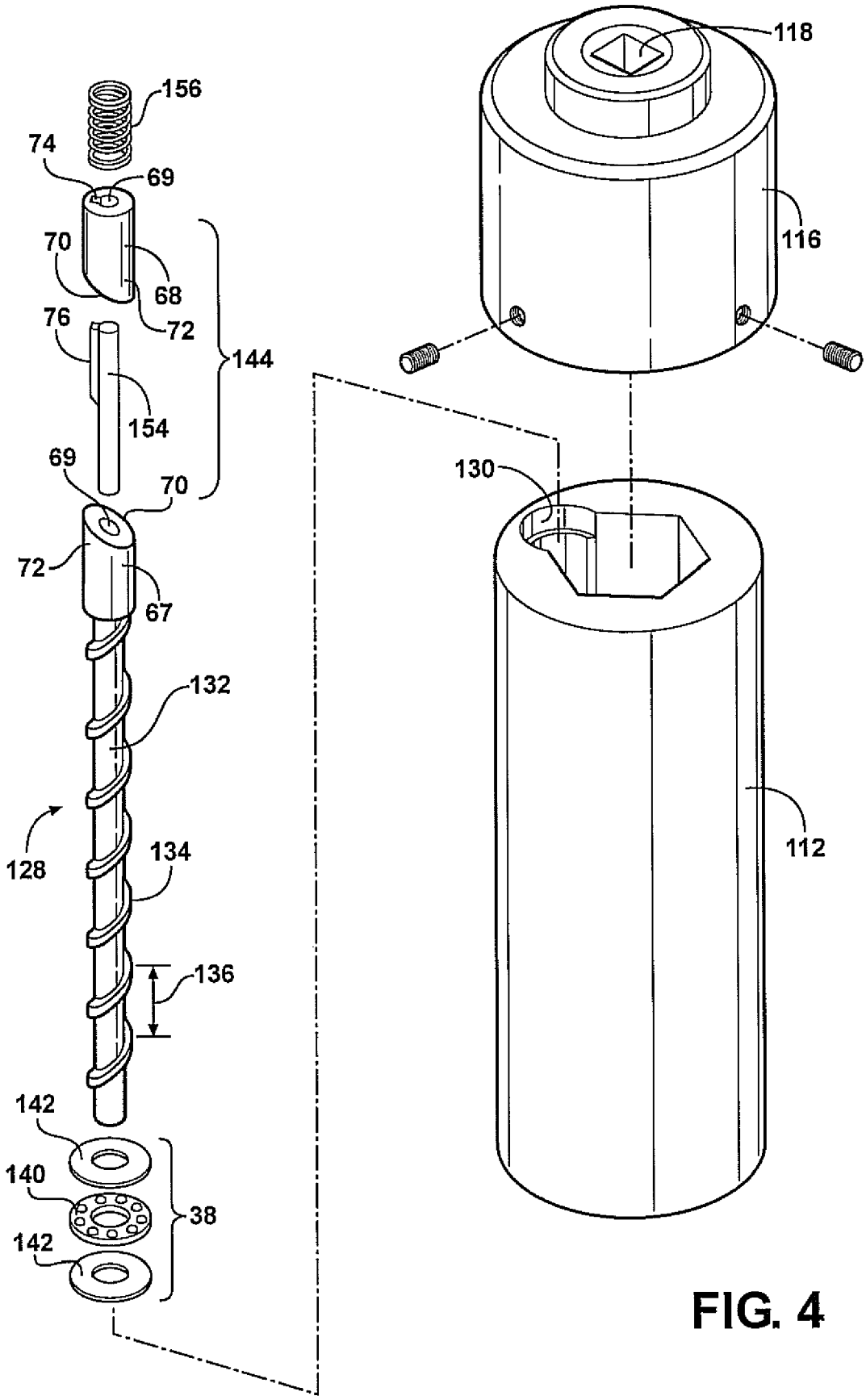
FIG. 4 is an exploded view of yet another embodiment of the first preferred embodiment of the tool showing the various parts.
Figure 5:
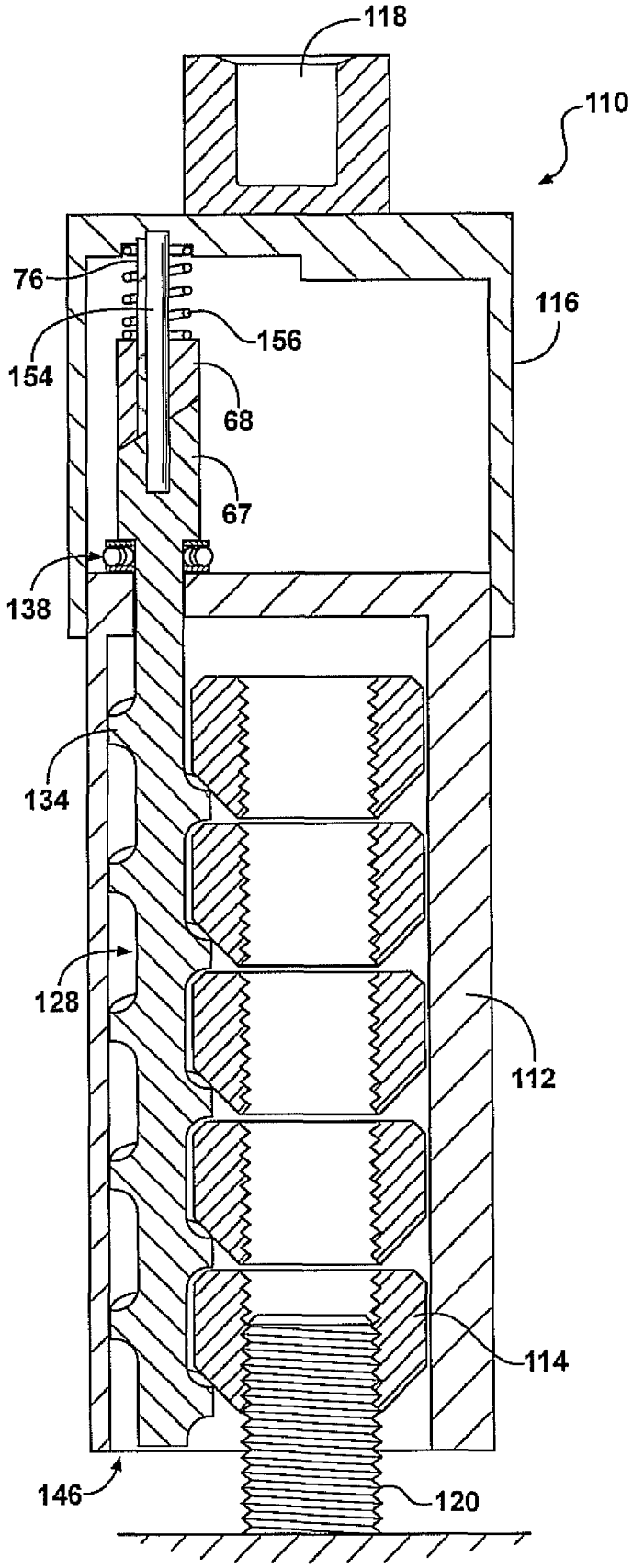
FIG. 5 is across-sectional view taken along the length of the assembled tool of FIG. 4.

With reference now to FIGS. 4 and 5, an illustration of another embodiment of a cam assembly 144 adaptable for use herein is provided. Like features have like reference numerals increased by 100. The cam assembly 144 includes a first and second cam 67, 68, each having a self aligning cam surface 70. The self aligning cam surfaces 70 are in contact with each other and rotate with respect to each other so as to return to a neutral position 46. The self aligning cam surfaces 70 are inversely proportional to each other such that the two cam surfaces 70 are generally flush against each other when one cam surface is urged against the other.

FIGS. 4 and 5 show the self aligning cam surfaces 70 defined by beveled ends 72 of the first and second cam 67, 68. Specifically, the beveled end 72 of one cam is supplemental to the beveled end 72 of the other. Thus as the two beveled ends 72 are urged against each other the first and second cam 67, 68 align themselves to form a generally uniform cylinder. However, it is anticipated that the cam ends need not be supplement to each other in order for the cam surfaces 70 to self align. For instance, the cam surfaces 70 may be inversely proportional to each other such that the two inverse pieces fit together to form a whole piece.

The cam assembly 144 also includes a guide pin 154 having a stop 76, and a spring 156. The first cam 67, referenced herein as the lower cam 67 is disposed below the second cam 68, referenced herein as the upper cam 68. Each of the cams 67, 68 includes an aperture 69 and the guide pin 154 is fitted within the aperture 69. The upper cam 68 includes a slot 74 configured to fittingly engage the stop 76 of the guide pin 154. The guide pin 154 is fixedly secured within the housing 116, and the spring 156 is mounted onto the guide pin 154 so as to urge the upper cam 68 against the lower cam 67.

With reference now to FIG. 4, the lower cam 67 is integrally mounted to the head of the shaft 132 of the worm gear 128. Though it is anticipated that the lower cam 67 may be fixedly secured to the shaft 132 using a fastening device such as a set screw 71, or by welding the lower cam 67 to the shaft 132. The guide pin 154 is fixedly mounted within the housing 116, and the lower cam 67 is rotatably mounted to the guide pin 154.

The upper cam 68 is also mounted onto the guide pin 154. The stop 76 of the guide pin 154 is inserted within the slot 74 of the upper cam 68 so as to prevent the upper cam 68 from rotating. However, the slot 74 extends along the length of the upper cam 68 so as to allow the upper cam 68 to move axially along the guide pin 154. The spring 156 is disposed between the upper cam 68 and the housing 116. Thus the spring 56 is operable to urge the upper cam 68 against the lower cam 67 so as to rotate the lower cam 67 and urge the lower cam 67 to return to a neutral position 146 wherein the self aligning cam surface 70 of both the lower cam 67 and upper cam 68 are flush against each other.

Similar to the operation of the previously described cam assembly 44, the self aligning cam surfaces 70 of the upper and lower cam 68, 67 are configured to rotate the worm gear 128 and return the worm gear 128 to a neutral position 146. As the worm gear 128 rotates, the catch 134 is also rotated so as to position the lug nut 14 axially along the elongated chamber 112 to an engaged position.

Thus it is inherent that the dimensions of the worm gear 128 correspond to the length of the exposed threaded stud 120. The catch 134 is rotated so as to move the lug nut 14 along the elongated chamber 112 and closer to the opening 122. Specifically, the worm gear 128 is rotated so as to move the lug nut 114 to the engaged position. In the engaged position, the forward most lug nut 114 is positioned so as to be in contact with a threaded stud 120 of a predetermined length such that the lug nut 114 may engage the threaded stud 120 and be applied onto the threaded stud 120.

In summary, the catch 134 of worm gear 128 stores the lug nuts 114 within the elongated chamber 112. The cam assembly 144 is operable to position the fastening devices 114 stored within the elongated chamber 112 in an engaged position by rotating the worm gear 128 to a neutral position 146 thus causing the catch 134 of the worm gear 128 to push the nut forward into an engaged position.

Figure 6:
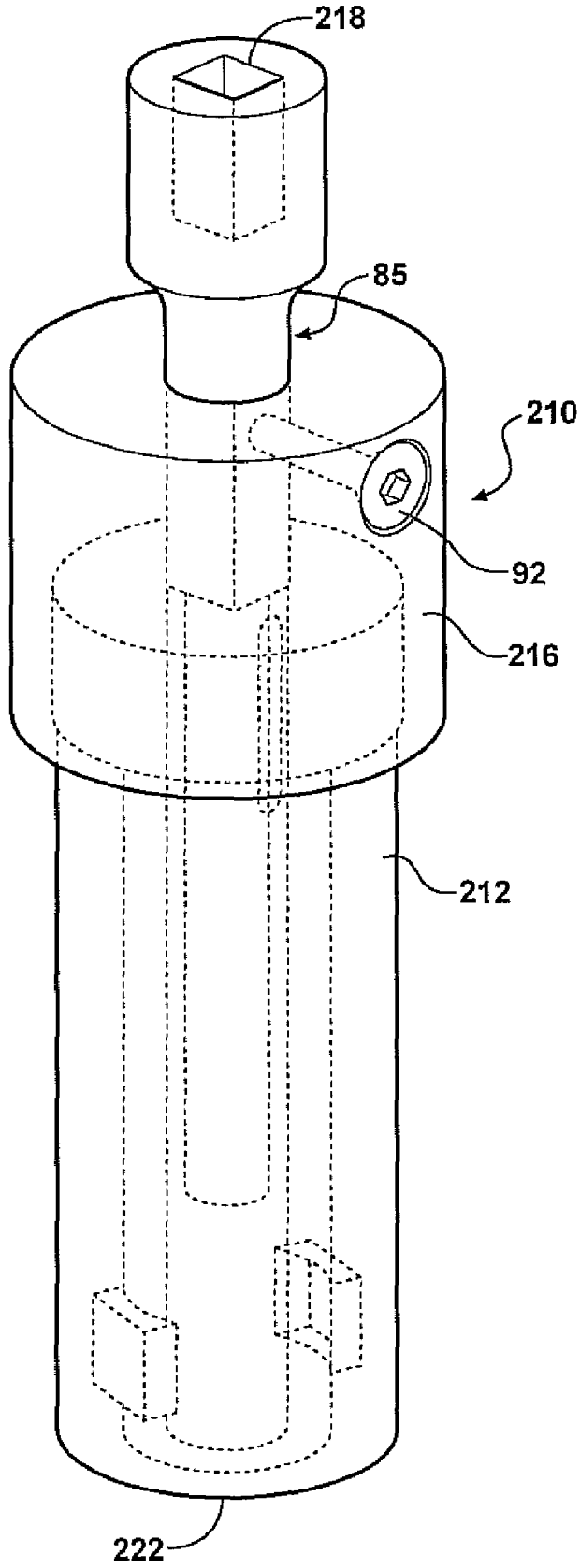
FIG. 6 an illustration of the second preferred embodiment of the tool.
Figure 7:
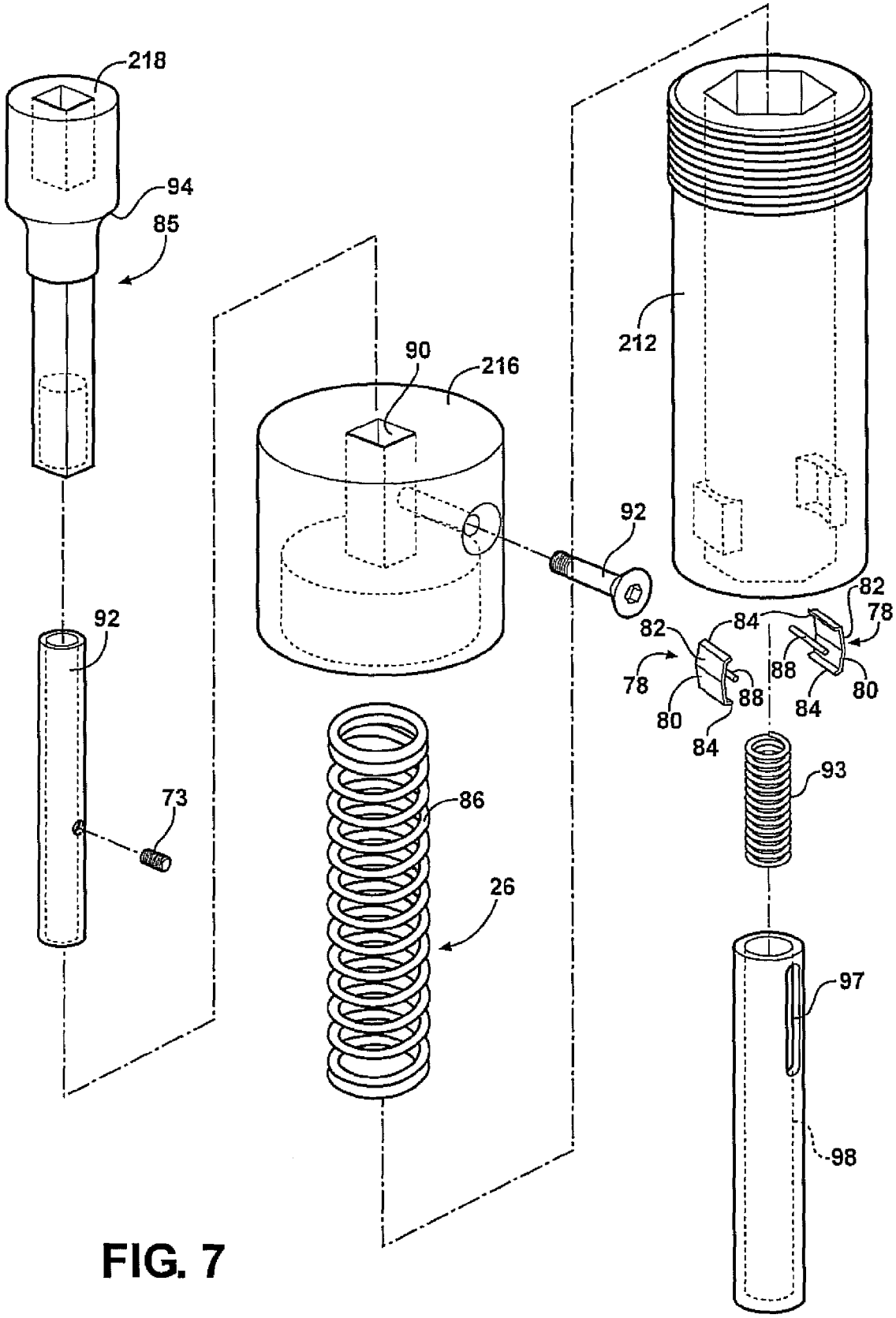
FIG. 7 is an exploded view of the tool of FIG. 6.
Figure 8:
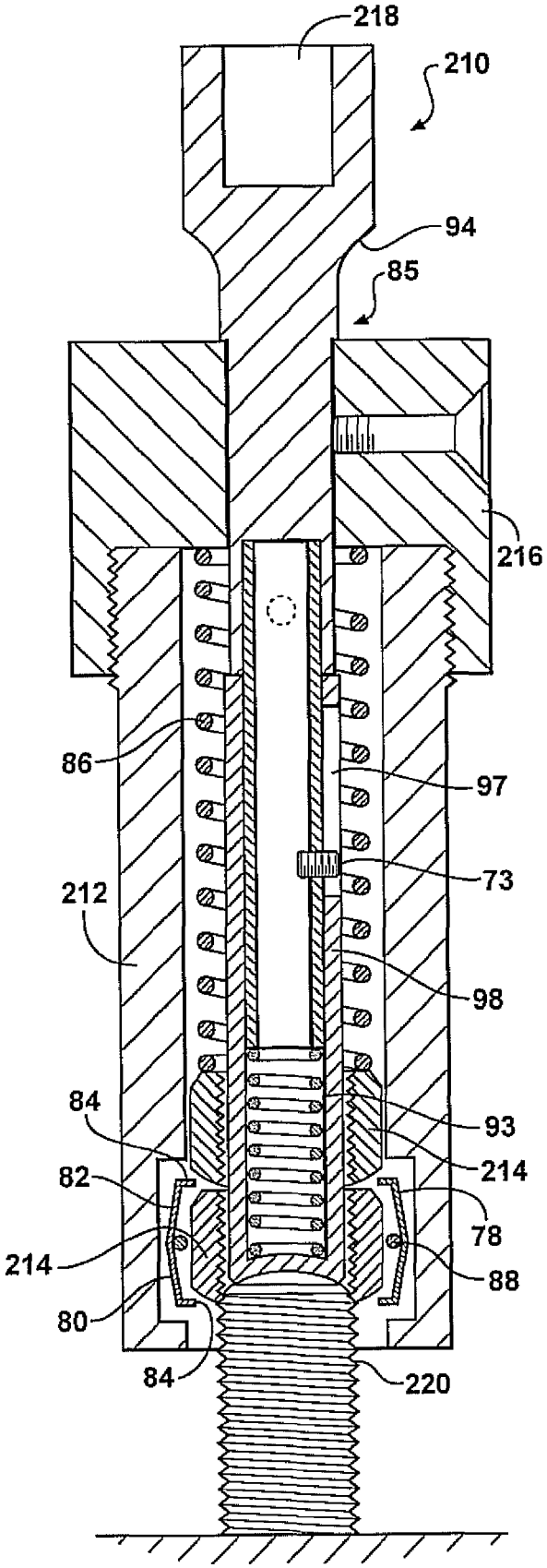
FIG. 8 is a cross-sectional view of an assembled tool of FIG. 7.

With reference now to FIGS. 6, 7 and 8 a second preferred embodiment is provided. Like features have like reference numerals increased by 200. The tool 210 also includes an elongated chamber 212 configured to fittingly engage a predetermined fastening device 214 having opposite beveled ends, a housing 216, and a drive shaft 85 assembly mounted within the housing 16. The drive shaft 85 assembly includes a socket 218 extending from the housing 216. Similar to the first preferred embodiment, the socket 218 is configured to receive the head of a device operable to turn the tool 210 so as to release or remove a fastening device 214 such as a lug nut 214 from a threaded stud 220. Such devices are currently known and used in the art, illustratively including a ratchet, or an impact gun. For illustrative purposes, the tool 210 is operable to remove and install a lug nut 214.

The retainer 224 includes a pair of keepers 78. Each keeper 78 is opposite and spaced apart from the other and disposed within the chamber 212. The keepers 78 are configured to grab and retain a lug nut 214. The keepers 78 include a first body portion 80 integral to a second body portion 82. The first body portion 80 is angled relative to the second body portion 82, and a flange 84 extends from the free end of each body portion. The flanges 84 are configured to engage the ends of the lug nut 214.

Preferably the keepers 78 are made of a strong metal such as spring steel. The keepers 78 are pivotably mounted within the chamber 212 through the use of a pair of pivot pins 88. The pivot pins 88 extend transversally through the chamber 212. The keepers 78 rest within the chamber 212 in a retaining position, wherein the flange 84 of the first and second body portion 80, 82 lie on the same general plane. The angled portion between the first and second body portion 80, 82 rides on the pivot pin, thus rocking the keeper 78 between a first position, and a second position. In the retaining position, the flanges 84 of the keepers 78 are pivoted towards each other such that the flanges 84 enclose the ends of the lug nut 214. In the first position, the flanges 84 closest to the opening 22 of the chamber 212 are pivoted away from each other thus forcing the flanges 84 furthest away from the opening 22 of the chamber 212 to pivot towards each other. In the second position, the flanges 84 closest to the opening 22 of the chamber 212 are pivoted towards each other thus forcing the flanges 84 furthest away from the opening 222 of the chamber 212 to pivot away from each other.

The positioning mechanism 226 includes a chamber spring 86. The chamber spring 86 is housed within the elongated chamber 212. The chamber spring 86 is disposed over a portion of the drive shaft 85, and extends from the housing 216 to the keepers 78. The chamber spring 86 is operable to urge the lug nuts 214 stored within the chamber 212 towards the opening 222 of the chamber 212 so as to position the lug nuts 214 for installation onto a stud 220.

Machining tolerances may produce variances in stud length. Thus, there may be instances where a portion of the stud 220 extends beyond the fastened lug nut 214. If the next lug nut 214 in the chamber 212 comes in contact with the exposed stud 220, there is a potential for the tool 210 to screw two lug nuts 214 onto one stud 220. Accordingly, the keepers 78 may be spaced a predetermined distance from the chamber opening 222 so as to prevent any lug nut 214 not retained between the keepers 78 from being inadvertently screwed onto the stud 220. Further, the keepers 78 are positioned within the chamber 212 such that the distal end of the stud 220 lies between the keepers 78.

The housing 216 is attached to the end of the chamber 212 opposite the opening 222. For instance, the housing 216 and chamber 212 are threaded and screwed onto each other. A passageway 90 extends through the center of the housing 216. The passageway 90 is shaped to receive the drive shaft 85 assembly such that a portion of the drive shaft 85 assembly extends through the housing 216. The drive shaft 85 assembly is fixed within the housing 216 by a device such as a screw 92 in order to prevent the drive shaft 85 from rotating within the elongated chamber 212. A portion of the drive shaft 85 and the passageway 90 of the housing 216 may be shaped so as to prevent the drive shaft 85 assembly from rotating within the housing 216. For instance, FIG. 7 shows a portion of the drive shaft 85 assembly having a generally square shape, and the passageway 90 having a complimentary square shape. Thus, the opening 222 of the chamber 212 is operable to turn a lug nut 214 as the tool 210 is rotated by a ratchet.

The drive shaft 85 assembly is fitted through the housing 216 such that a portion of the drive shaft 85 assembly extends into the chamber 212. The drive shaft 85 assembly further includes a rod 92 extending away from the socket 218. The socket 218 may further include a shoulder wherein the shoulders abut against the housing 216. The shoulder prevents the drive shaft 85 from further penetrating the elongated chamber 212.

The tool 210 further includes an alignment tube 98 slidably mounted onto the rod 92. The alignment tube 98 has an outer surface configured to fit within the opening of a lug nut 214, as shown in FIG. 8. The alignment tube 98 helps center the lug nuts 214 within the elongated chamber 212. Preferably the alignment tube 98 is hollow and includes a slot 97. The tool 210 further includes a stopping member 73 fitted within the slot 97 of the alignment tube 98 and fixed to the rod 92. Thus, the alignment tube 98 is slidable mounted to the drive shaft 85 so as to accommodate tolerances in stud length.

An alignment spring 93 is disposed within the hollow alignment tube 98 and abuts against the end of the rod 92 of the drive shaft 85. As the lug nut 214 is released from the stud 220, the opening of the lug nut 214 engages the alignment tube 98. Thus, the alignment spring 93 provides for variance in exposed stud length, which helps ensure that the tool 210 may be pushed flush against the structure that the stud 220 is mounted on. Accordingly, the alignment tube 98 may be urged towards the socket 218 to accommodate a predetermined variance in stud length.

In operation, the tool 210 is attached to a device such as an impact gun or a ratchet. To remove a lug nut 214, the opening 222 of the chamber 212 is placed over a lug nut 214. Preferably, the opening 222 of the elongated chamber 212 completely encloses the lug nut 214 and the tool 210 is flush against the structure in which the lug nut 214 is secured to. When the tool 210 is mounted onto a lug nut 214, the beveled end of the lug nut 214 abuts against the flange 84 of the first body portion 80 of the keepers 78, causing the keepers 78 to pivot into the first position. As the lug nut 214 advances into the chamber 212 the forward end of the lug nut 214 abuts against the second body portion 82 causing the keeper 78 to pivot towards the retaining position.

The impact gun may then be operable to rotate the drive shaft 85 and remove the lug nut 214 from the stud 220. The lug nut 214 moves axially along the stud 220 as the tool 210 unscrews the lug nut 214. Once the lug nut 214 is free of the stud 220, the keepers 78 are pivoted to the second position. Specifically, a portion of lug nut 214 is pushed beyond the keepers 78 because the distal end of the stud 220 lies between the keepers 78. Once the lug nut 214 is free of influence from the stud 220, the chamber spring 86 urges the lug nut 214 between the keepers 78.

The tool 210 may be placed over a second lug nut 214. The second lug nut 214 is then retained between the keepers 78 and displaces the first lug nut 214, pushing the first lug nut 214 further into the chamber 212. The second lug nut 214 continues to push the first lug nut 214 further into the chamber 212 as the tool 210 unscrews the second lug nut 214 from the stud 220. When the second lug nut 214 is free of the stud 220, a portion of the second lug nut 214 remains between the keepers 78. The remaining portion is advanced further into the chamber 212, pivoting the keepers 78 into the second position.

Once the tool 210 is release from the stud 220, the chamber spring 86 urges the first lug nut 214 forward causing the second lug nut 214 to move between the keepers 78. As the second nut advances, the beveled end of the second lug nut 214 abuts against the first body portion 80 of the keepers 78 and pivots the keepers 78 into the first position. Thus, the flanges 84 of the second body portion 82 are pivoted towards each other and prevent the chamber spring 86 from advancing the first lug nut 214 forward so as to prevent the first lug nut 214 from moving between the pair of keepers 78. Thus, flanges 84 of the second body portion 82 prevent the first nut from advancing and pushing the second lug nut 214 out of the chamber 212.

This cycle continues until the chamber 212 cannot hold any more lug nuts 214. Preferably the chamber 212 and alignment tube 98 are long enough to hold at least five lug nuts 214 as those are the standard amount of lug nuts 214 found on a wheel. However, the length of the barrel chamber 212 and alignment tube 98 may increase or decrease depending upon such factors as the type of lug nut 214 the tool 210 is configured to engage, and the amount of lug nuts 214 desired to be stored.

To apply the stored lug nuts 214 onto a stud 220, the impact gun may be operable to rotate the drive shaft 85 so as to rotate the chamber 212 and screw the lug nuts 214 onto a stud 220. When the lug nut 214 held between the keepers 78, referenced as the first lug nut 214, is pushed onto the stud 220 for application, the stud 220 pushes the first lug nut 214 further into the chamber 212 and against the second body portions 82 of each keeper 78 so as to pivot the keepers 78 into the second position. As the first lug nut 214 moves axially along the stud 220 towards the base of the stud 220, the chamber spring 86 urges the following lug nut 214 in between the keepers 78. When the first lug nut 214 reaches the base, the tool 210 is removed. As the tool 210 is pulled away, the first lug nut 214 abuts against the first body portion 80 causing the keepers 78 to pivot in the first position wherein the flanges 84 of the second body pivot towards each other. Thus the chamber spring 86 is prevented from urging any lug nut 214 upstream the keepers 78 from pushing the lug nut 214 held within the keepers 78 out of the chamber 212.

Accordingly a lug nut 14 installation tool 10 is provided that can install and remove lug nuts 14 to and from a stud 20.

The tool 10 also retains the removed lug nuts 14 and positions the lug nuts 14 for later installation onto studs 20.

The invention claimed is:

1. A tool for removing and applying a fastening device to and from a threaded stud, the tool comprising:

a housing;

a socket mounted on the housing;

an elongated chamber spaced apart and opposite the socket, the elongated chamber extending from the housing and away from the socket, the elongated chamber having a predetermined length and configured to hold a predetermined number of fastening devices, the elongated chamber including an opening configured to fittingly engage the fastening device;

a retainer configured to hold the fastening device, the retainer having a worm gear rotatable mounted within the elongated chamber, the worm gear having a shaft and a catch spiraling along the shaft, and wherein the fastening device is held between opposite portions of the catch, the housing displacing the fastening device longitudinally within the elongated chamber so as to remove the fastening device from the threaded stud and position the fastening device for later installation onto the threaded stud.

2. The tool as set forth in claim 1, further including a worm gear chamber in communication with the elongated chamber, the worm gear chamber extending axially along the elongated chamber, and wherein the worm gear is disposed within the worm gear chamber, and wherein a portion of the catch extends into the elongated chamber.

3. The tool as set forth in claim 2, further including a positioning mechanism includes a first cam fixedly mounted on the shaft, the first cam having a cam surface that is angled relative to the elongated chamber so as to be sloped, the positioning mechanism further including a cam follower rotatably mounted onto a cam follower base, a guide pin mounted onto the cam follower base, and a spring disposed within the housing, and wherein the spring urges the cam follower against the cam surface of the first cam so as to pivot the worm gear and urge the worm gear into a neutral position.

4. The tool as set forth in claim 3, wherein the cam follower further includes a plurality of rollers, each of the plurality of rollers extending transversely across the inner surface of the cam follower, wherein plurality of rollers rotate against the inner surface of the cam follower so as to facilitate the rotation of the axial cam.

5. The tool as set forth in claim 4, further including a retaining arm, the retaining arm including an arm and a retaining body, wherein the arm is engaged with the retainer and the retaining body is fixedly secured to the cam follower base so as to secure the cam follower to the cam surface.

6. The tool as set forth in claim 1, further including a bearing assembly having a plurality of bearings and washers, wherein the bearing assembly is mounted onto the shaft of the worm gear so as to facilitate the rotary movement of the worm gear.

7. The tool as set forth in claim 1, further including a positioning mechanism having a first cam and a second cam disposed within the housing, the first and second cam each have a self aligning cam surface, a guide pin fixedly mounted to the housing, and a spring, the first and second cams are mounted to the guide pin and the self aligning cam surface of the first cam is facing and in contact with the self aligning surface of the second cam, the first cam is rotatably mounted to the guide pin and the second cam is slidably mounted to the guide pin, the spring is disposed between the second cam and housing so as to urge the second cam towards the first cam rotating the first cam until the self aligning face of the first cam comes to rest against the self aligning face of the second cam.

8. The tool as set forth in claim 7, wherein the self aligning cam surface of the first cam is the inverse of the self aligning cam surface of the second cam.

9. The tool as set forth in claim 7, wherein both the first cam and second cam have a beveled end, and wherein the beveled ends are in contact with each other.

10. The tool as set forth in claim 7, wherein the guide pin includes a stop extending axially along the guide pin, and wherein the second cam includes a slot extending axially along a portion of the second cam, the slot configured to fittingly receive the stop.

11. A tool for removing and applying a fastening device to and from a threaded stud, the tool comprising:

a housing;

a socket mounted on the housing;

an elongated chamber spaced apart and opposite the socket, the elongated chamber extending from the housing and away from the socket, the elongated chamber having a predetermined length and configured to hold a predetermined number of fastening devices, the elongated chamber including an opening configured to fittingly engage the fastening device; and a pair of keepers pivotably mounted in the elongated chamber, each of the pair of keepers including a flange disposed at each end of each of the pair of keepers, each of the pair of keepers pivoting between a first position wherein one pair of corresponding ends of each of the pair of keepers is pivoted away from each other, and a second position wherein the other pair of corresponding ends of each of the pair of keepers is pivoted away from each other.

12. The tool as set forth in claim 11, wherein the positioning mechanism includes a chamber spring, the chamber spring extending from the housing to the keepers.

13. The tool as set forth in claim 11, wherein each of the pair of keepers includes a first body portion and a second body portion, wherein the first body portion is angled relative to the second body portion.

14. The tool as set forth in claim 11, further including a pair of pivot pins, wherein one of the pair of keepers pivots about one of the pair of pivot pins, and the other of the pair of keepers pivots about the other of the pair of pivots pins.

* * * * *